US012258169B2

(12) United States Patent
Van De Hey et al.

(10) Patent No.: US 12,258,169 B2
(45) Date of Patent: Mar. 25, 2025

(54) TRI-FOLD MACHINE AND PROCESS

(71) Applicant: C3 Corporation, Appleton, WI (US)

(72) Inventors: Joseph F. Van De Hey, Kaukauna, WI (US); Jeffery J. VanHandel, Freedom, WI (US); Alex M. Zirbel, Kaukauna, WI (US); Alex N. Kuffel, Appleton, WI (US)

(73) Assignee: C3 Corporation, Appleton, WI (US)

( * ) Notice: Subject to any disclaimer, the term of this patent is extended or adjusted under 35 U.S.C. 154(b) by 479 days.

(21) Appl. No.: 17/565,116

(22) Filed: Dec. 29, 2021

(65) Prior Publication Data

US 2022/0119145 A1 Apr. 21, 2022

Related U.S. Application Data

(63) Continuation-in-part of application No. PCT/US2021/028873, filed on Apr. 23, 2021.

(60) Provisional application No. 63/085,052, filed on Sep. 29, 2020.

(51) Int. Cl.

| | |
|---|---|
| ***B65B 63/04*** | (2006.01) |
| ***B65B 25/00*** | (2006.01) |
| ***B65B 63/02*** | (2006.01) |

(52) U.S. Cl.

CPC ..... *B65B 63/04* (2013.01); *B65B 25/00* (2013.01); *B65B 63/02* (2013.01)

(58) Field of Classification Search

CPC ..... B65B 35/24; B65B 35/22; B65B 9/02; B65B 25/00; B65B 11/50; B65B 25/145; B65B 63/02; B65B 63/04

See application file for complete search history.

(56) References Cited

U.S. PATENT DOCUMENTS

| | | | |
|---|---|---|---|
| 2,362,976 | A | 11/1944 | Cooper |
| 7,059,101 | B2 | 6/2006 | Dextraze et al. |
| 8,333,279 | B2 | 12/2012 | Veiseh |
| 8,496,637 | B2 | 7/2013 | Hundorf et al. |

(Continued)

FOREIGN PATENT DOCUMENTS

| | | | |
|---|---|---|---|
| BR | 102018072864 | A2 * | 5/2020 |
| CN | 110053837 | B | 9/2020 |

(Continued)

OTHER PUBLICATIONS

Machine translation of CN-111605837-A (Year: 2020).*

(Continued)

*Primary Examiner* — Anna K Kinsaul
*Assistant Examiner* — Himchan Song
(74) *Attorney, Agent, or Firm* — Amundsen Davis, LLC

(57) ABSTRACT

A tri-fold machine and process to fold up compressed high expansion force material. The machine includes a left-side horizontal conveyor and a right-side horizontal conveyor with a middle conveyor therebetween. A pair of longitudinal bars are operable between (i) a raised position and (ii) a lowered position. The right-side and left-side conveyors are each movable between a horizontal home position and a folding position. A middle portion of the material is held in longitudinal gaps formed on each side of the middle conveyor. A left side of the material is folded over the middle portion of material. A right side of the material is folded over the left side of the material which is over the middle portion.

22 Claims, 9 Drawing Sheets

(56) References Cited

U.S. PATENT DOCUMENTS

| | | | | |
|---|---|---|---|---|
| 2011/0266188 | A1* | 11/2011 | Share | B65B 63/026 53/436 |
| 2015/0203221 | A1 | 7/2015 | Hey et al. | |
| 2016/0304231 | A1 | 10/2016 | Corodemus | |
| 2022/0144462 | A1* | 5/2022 | Tan | B65B 35/24 |

FOREIGN PATENT DOCUMENTS

| | | | | |
|---|---|---|---|---|
| CN | 111605837 | A * | 9/2020 | B65B 63/04 |
| FR | 2861693 | A1 * | 5/2005 | B65B 63/02 |
| FR | 2861693 | B1 | 3/2006 | |
| JP | 2009213554 | A | 9/2009 | |
| KR | 101784936 | B1 | 10/2017 | |
| KR | 101860373 | B1 * | 5/2018 | |

OTHER PUBLICATIONS

Machine translation of FR-2861693-A1 (Year: 2005).*
Machine translation of KR-101860373-B1 (Year: 2018).*
Machine translation of BR-102018072864-A2 (Year: 2020).*
Atlanta Attachment Co, "1390HCB—Automatic Mattress Packaging with Compression, Single Fold & Roll Pack" YouTube video, retrieved from the internet on or before Sep. 28, 2020 at https://www.youtube.com/watch?v=sO0Zf8gQ3UE, 43 pages filed herewith.
C3 Corporation, description by Applicant of its bi-fold machine and process for making compressed rolled up product from high expansion force material, like a mattress, the machine and process has been available to the public at least as early as Sep. 28, 2020, 1 page filed herewith.
Elektroteks, "ET-ROLL-210 Mattress Compress and Roll Pack Machine with Manual Folding" YouTube video, retrieved from the internet on or before Sep. 28, 2020 at https://www.youtube.com/watch?v=tjx4MRP63uE, 35 pages filed herewith.
Hanvey Huang, "Automatic Mattress Folding Compress Roll Pack Machine" YouTube video, retrieved from the Internet on or before Sep. 28, 2020, 46 pages filed herewith.
Made-in-China, "Ng-22RS Fully Automatic Mattress Compression Rolling and Folding Wrapping Packing Mattress Machine", retrieved from the internet on or before Sep. 28, 2020 at https://cnnaigu.en.made-in-china.com/product/iZDaPHsugAkG/China-Ng-22RS-Fully-Automatic-Mattress-Compression-Rolling-and-Folding-Wrapping-Packing-Mattres-Machine.html, 11 pages filed herewith.
Mattress Clarity, "How To Compress, Fold And Roll Up A Memory Foam Mattress—Bed In a Box Secrets!" YouTube video, retrieved from the internet on or before Sep. 28, 2020 at https://www.youtube.com/watch?v=6ZDGDIrXepg, 50 pages filed herewith.
Search Report & Written Opinion for PCT Patent Application No. PCT/US2021/028873, "Tri-Fold Machine and Process" dated Aug. 6, 2021, 12 pages filed herewith.

* cited by examiner

TRI-FOLD MACHINE AND PROCESS

CROSS-REFERENCE TO RELATED APPLICATIONS

This application is a continuation-in-part of PCT/US2021/028873 filed Apr. 23, 2021 titled: TRI-FOLD MACHINE AND PROCESS, and claims the benefit of U.S. Provisional Application No. 63/085,052, filed Sep. 29, 2020 titled: TRIFOLD SYSTEM FOR COMPRESSED HIGH EXPANSION FORCE MATERIAL.

TECHNICAL FIELD

This invention relates to folding of product in a commercial setting to aid in packaging the same. More specifically, it concerns tri-folding compressed high expansion force material that is then rolled up into highly compressed rolls. Such rolls are easier and less expensive to handle, store and ship.

BACKGROUND

In many industries, large quantities of compressible materials must be stored and transported around. Compressing these materials into smaller volumes often results in significant cost savings, but can also cause product defect or pre-mature product degradation. Compressible foam materials such as polyurethane foam layers or other foam types as various combinations of layers like a mattress, including pockets of coils and springs for use in mattress construction, are just a few examples of materials which are more efficiently handled in a compressed form for storage and shipping.

To be compressed, such products are also often folded, rolled, folded and rolled, or rolled and rolled, to attain an even smaller package size. The rolling/folding/combination operation is often preceded by a stage of compressing the compressible materials, and in particular a mattress, in order to first reduce the thickness thereof and therefore reduce the maximum diameter of a packaged product when formed into a spiral-rolled product. The compressible product is wrapped in loose plastic or plastic-like material, and then compressed in a press, often times highly compressed to a volume six times to twelve times less than its pre-compressed volume. At the end of the compressing action that substantially flattens the once thick material to about 0.5 inch to about 2 inches in height, a welding bar is activated to join and seal the side flaps of the plastic wrapping the mattress product, thus sealing the product inside the plastic from the outside environment, and preventing the mattress from readily expanding back to its pre-compressed height and volume after the press is opened due to the restrictive plastic wrapping.

The compressed mattress product then advances along in flattened form to a machine and process for folding and/or spiral-rolling of the product. If folded, existing equipment only enables folding the product in half. Storage of the folded/rolled product can then occur, for example, by insertion in a pre-formed bag or being wrapped with stretch wrap around a circumference of the product as part of the spiral-rolling process near the time rolling of the product concludes in the rolling machine. Additionally, this spiral rolled product can then be subjected to a further rolling process to further reduce the overall size of the rolled material, a so-called roll of a roll. All of this is toward the goal of rolling the compressible product wound up on itself in a very tight manner so as to prevent it from occupying too great a volume during transport and storage. The greater the final compression ratio of the product, the cheaper the transport and storage.

There are a variety of characteristics to consider when a high expansion force product like a rolled compressed material, such as a mattress product, is made into a smaller product footprint for storage and shipping. Often these characteristics compete with each other and even move each other in opposite directions. Thus, there is a need to address one or more of the deficiencies in the art to better aid in achieving desirable characteristics and/or avoid negative ones, toward finish packaging of product for consistent and reliable shipment of the high expansion force product until it arrives at an end user, who will unpackage and unwrap the tightly compressed and rolled up high expansion force product.

SUMMARY

To address one or more deficiencies in the art and/or better achieve the desirable characteristics in packaging, storing and/or ultimately using rolled compressible material, there is provided a tri-fold machine to fold up compressed high expansion force material. For example, with this machine and process, it is now possible unlike before to take more finish length out of the flat product footprint and get the final product into an even smaller box. As one example, the difference can be now enabling an end package that is 16-inches by 30-inches, versus a prior 16-inches by 42-inches, thus taking a foot out of the box length so in final packaging the user can fit more boxes on the shelf, pallet, truck etc. That is, and without being limited to a theory of understanding, tri-folding adds another level of capability to the packaging process unlike possible before. And, preferably, the tri-fold machine and process is adjustable to enable various tri-fold configurations relative to a middle portion of the material being folded. The machine includes a left-side horizontal conveyor next to a middle conveyor with a left longitudinal gap formed between the left-side horizontal conveyor and the middle conveyor. The machine also includes a right-side horizontal conveyor next to an opposite side of the middle conveyor with a right longitudinal gap formed between the right-side horizontal conveyor and the middle conveyor. An upper surface of each of the left-side horizontal conveyor and the right-side horizontal conveyor are defining a horizontal plane. A left longitudinal bar is operable between (i) a raised position where a bottom surface is spaced from and above the horizontal plane and (ii) a lowered position where the bottom surface is located closer to the horizontal plane than in the raised position. A right longitudinal bar is operable between (i) a raised position where a bottom surface is spaced from and above the horizontal plane and (ii) a lowered position where the bottom surface is located closer to the horizontal plane than in the raised position. The right-side conveyor is movable between a horizontal home position and a folding position. The folding position is where the right-side conveyor is located above and extending over the middle conveyor. The left-side conveyor is movable between a horizontal home position and a folding position. The folding position is where the left-side conveyor is located above and extending over the middle conveyor.

In a different embodiment there is a process for tri-folding a compressed high expansion force material. The process includes positioning the material on a left-side horizontal conveyor and a right-side horizontal conveyor, with a middle conveyor located between the left-side horizontal conveyor and the right-side horizontal conveyor and a longitudinal gap formed on each side of the middle conveyor. A next step in the process is pressing a middle portion of the material into the longitudinal gap formed on each side of the middle conveyor. Another step is folding a left side of the material over the middle portion of material. And, another steps is folding a right side of the material over the left side of the material which is located over the middle portion of the material.

Also described herein are options directed to configurations of the conveyors, the longitudinal bars and the material, as well as functions of these and related use of in a process, and their interactions to achieve the desired folded state for the compressed high expansion force material.

As used herein, "high expansion force material" means a material that is (i) reduced in volume by flattening it to a flattened volume that is at least two times less than its pre-compressed volume, and preferably reduced to a flattened volume that is at least four times less than its pre-compressed volume, more preferably at least 6 times, at least 8 times or at least 10 times, and (ii) the material is resilient to recover to at least about 90% of its pre-compressed volume, preferably to at least about 95% of its pre-compressed volume and more preferably 98%, when at a temperature of about 70 degrees Fahrenheit for a period of one hour and the restrictive means causing it to be reduced in volume is removed from the material.

BRIEF DESCRIPTION OF THE DRAWINGS

The invention may be more completely understood in consideration of the following detailed description of various embodiments in connection with the accompanying drawings, in which.

Figure 1:
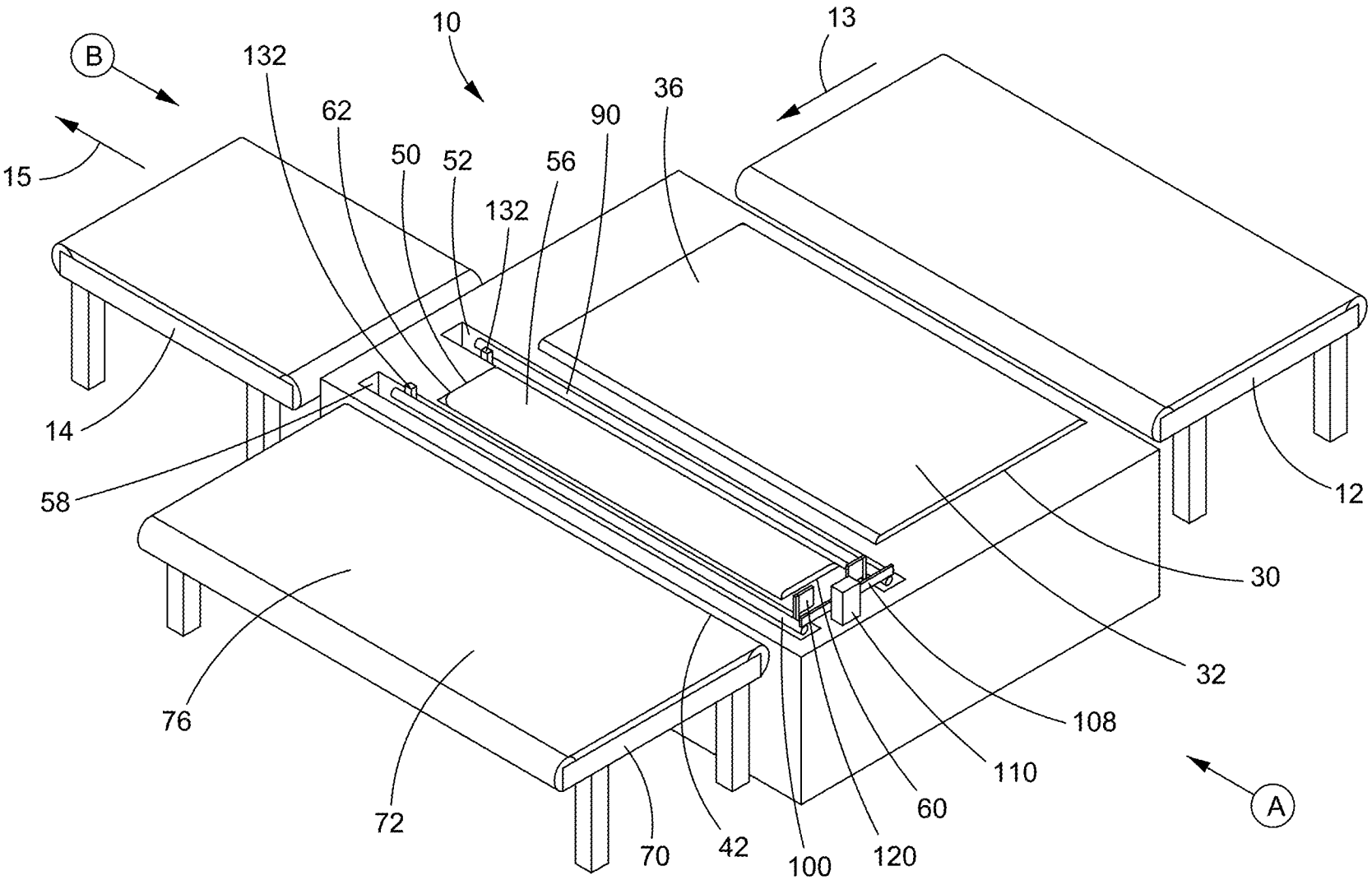
FIG. 1 is a perspective view of a tri-fold machine to fold up compressed high expansion force material.

The drawings show some but not all embodiments. The elements depicted in the drawings are illustrative and not necessarily to scale, and the same (or similar) reference numbers denote the same (or similar) features throughout the drawings.

DETAILED DESCRIPTION

Figure 2:
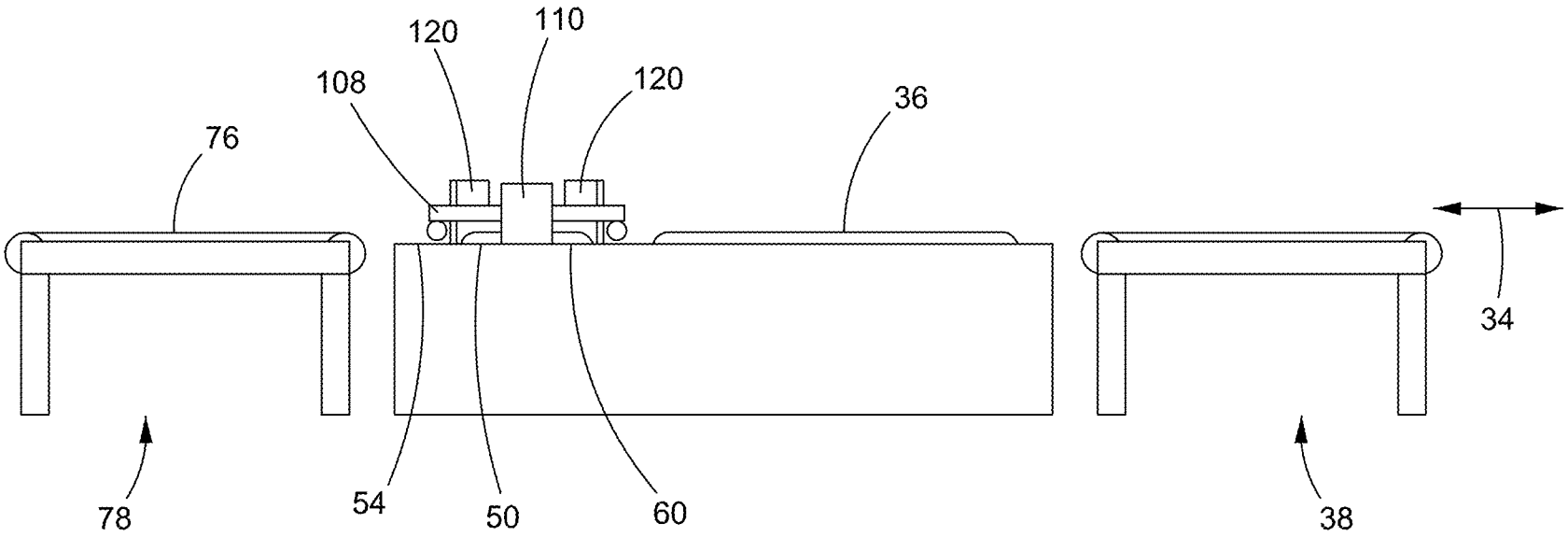
FIG. 2 is an end view of that seen in FIG. 1, taken from vantage point A looking at the machine.
Figure 3:
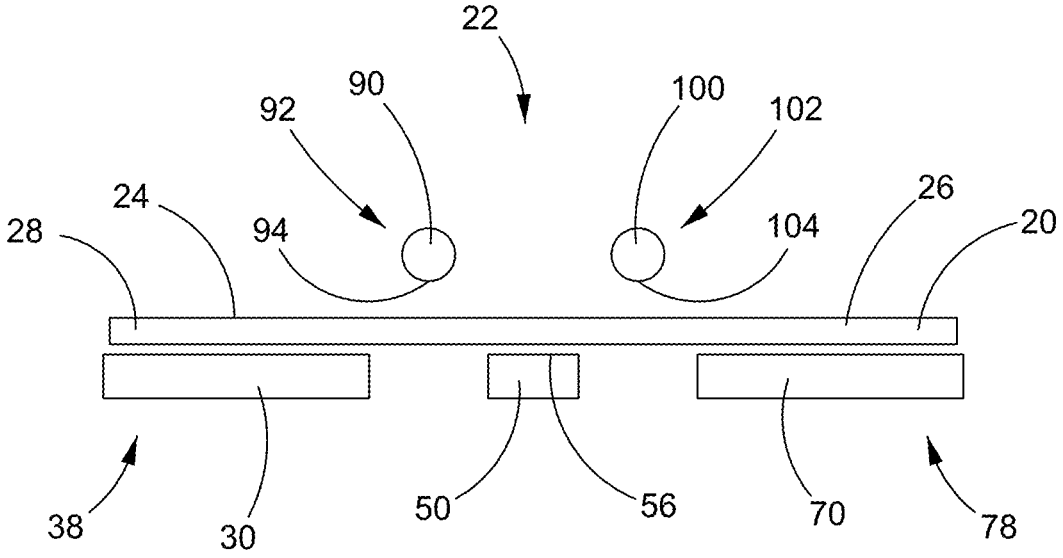
FIG. 3 is a schematic end view of that seen in FIGS. 1 and 2, taken from vantage point B looking at the machine, and with the compressed high expansion force material located in the material folding position.
Figure 4:
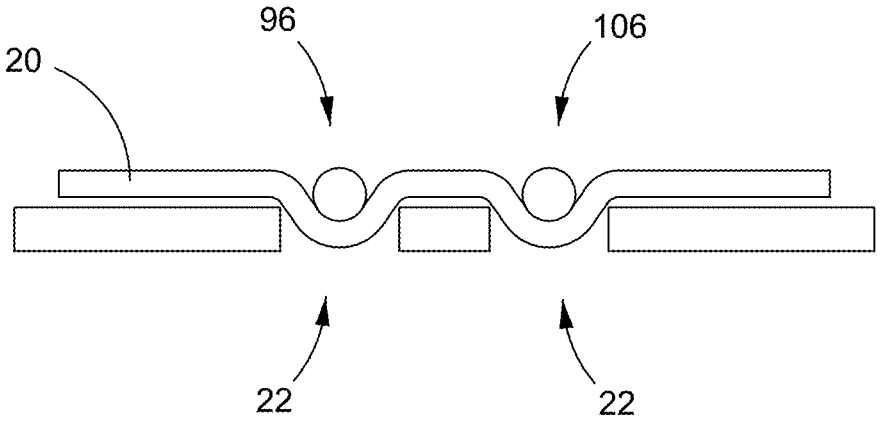
FIG. 4 is a schematic end view of that seen in FIG. 3, and with the pair of longitudinal bars in the lowered position.

In accordance with the practice of at least one embodiment, as seen in the Figures for example, there is a tri-fold machine 10 to fold up compressed high expansion force material 20, such as a mattress product. In order to see certain structures, vantage point A is employed in FIGS. 1 and 2. However, for the discussion of FIGS. 3-10, vantage point B is employed to give meaning to the left and right orientation of machine parts. As should be clear to one or ordinary skill in the art, in combination with the teaching herein, the opposite orientation could be easily employed and is interchangeable therewith by flipping from the B vantage point to the A vantage point, if desired. Accordingly, from the B vantage point, there is a left-side horizontal conveyor 30 next to a middle conveyor 50. A left longitudinal gap 52 is formed between the left-side horizontal conveyor 30 and the middle conveyor 50. A right-side horizontal conveyor 70 is next to an opposite side 54 (FIG. 2) of the middle conveyor with a right longitudinal gap 58 formed between the right-side horizontal conveyor 70 and the middle conveyor 50. An upper surface 32, 72 of each of the left-side horizontal conveyor and the right-side horizontal conveyor defines a horizontal plane 34. Additionally, the left-side horizontal conveyor 30 and the right-side horizontal conveyor 70, preferably, each have a movable surface 36, 76 to locate the material 20 into a material folding position (as seen in FIG. 3) relative to a left longitudinal bar 90 and a right longitudinal bar 100. Surfaces 36, 76, and also preferably 56, could be belts, rollers, forced air or other conventional mechanical transport mechanisms, as can be arranged to form a horizontal surface or horizontal-like surface. Movable surfaces 36, 56, 76, can move in direction of travel 13 to receive compressed material 12 from a conventional upstream conveyor 12. Conveyor 12 itself, or prior to material 20 arriving there, transformed a conventional compressible product, like a mattress, into the compressed high expansion force material 20 using conventional compression equipment and techniques. Thus, prior to folding, the material 20 is positionable on the left-side conveyor and the right-side conveyor, preferably with each of the left longitudinal bar and the right longitudinal bar overlying a middle portion 22 of the material (FIG. 3).

The left longitudinal bar 90 is operable between (i) a raised position 92 where a bottom surface 94 is spaced from and above the horizontal plane 34 (FIG. 3) as well as spaced from the top surface 24, and (ii) a lowered position 96 where the bottom surface 94 is located closer to the horizontal plane 34 than in the raised position. The right longitudinal bar 100 is also operable between (i) a raised position 102 where a bottom surface 104 is spaced from and above the horizontal plane 34 (FIG. 3) as well as spaced from the top surface 24, and (ii) a lowered position 106 where the bottom surface 104 is located closer to the horizontal plane 34 than in the raised position. Preferably, the left longitudinal bar and the right longitudinal bar are coupled together, for example by a cross bar 108, such that each longitudinal bar 90, 100 is movable between the raised position and the lowered position simultaneously, i.e., in a vertical direction relative to the horizontal surfaces 32, 72. This can be accomplished, for example, by a bar raising linkage 110 that also extends below the machine folding surface and uses a conventional mechanism to move the bars 90, 100 up and down as desired. Preferably, the bottom surface 94, 104 of at least one of the left longitudinal bar and the right longitudinal bar is equal with to below the horizontal plane when in the lowered position (e.g., FIGS. 4 to 8A, inclusive), and more preferably both surfaces 94,104 can be so located in the lowered position simultaneously. That is, preferably, bottom surface(es) 94, 104 is/are in contact with top surface 24 of the material when the longitudinal bar 90, 100 is in the lowered position. Still more preferably in this regard, at least one of the longitudinal bars 90, 100 press(es) the material into the respective longitudinal gaps 52, 58 when the longitudinal bar(s) 30, 70 is in the lowered position. Without being limited to a theory of understanding, the inventors have discovered such positioning of one or more of the surfaces 94, 104 can be desirable to aid in holding the material in place relative to the conveyors 30, 50 and 70, and can be still more desirable to also help impart crisp and clear fold lines/areas, as discussed herein. Still more preferably, when desired for storage, left longitudinal bar 90 is sized to fit completely in the left longitudinal gap 52, as is right longitudinal bar 100 sized to fit completely in the right longitudinal gap 58, and this occurs when material 20 is not present.

In other aspects concerning the longitudinal bars 90, 100, they can be adjustable, in a horizontal direction 98 (FIGS. 11 and 12), as well as the vertical direction (i.e., positioned between raised positions 92, 102 and lowered positions 96, 106 and anywhere in between). That is, preferably: (i) one of the bars 90 or 100 can be fixed relative the conveyors 30, 50, 70 and the other of the bars 100 or 90 adjustable relative to that bar, or (ii) both bars 90 and 100 can be adjustable relative to the conveyors 30, 50, 70 and each other bar 100, 90, respectively. In this way, and without being limited to a theory of understanding, this enables various tri-fold configuration sizes of middle portion 22 of the material relative to right side 26 and left side 28, when material 20 is folded. For example, the middle portion width in horizontally direction 98 is determined by the horizontal spacing of the bars 90, 100, and so can make the middle be a true one-third of the overall width of material 20, or something less or greater than that, as desired. Further, more preferably, the bars 90, 100, while adjustable as discussed, are temporarily fixed relative to one another when being used to fold the material around the bars. However, it is also contemplated that one of the bars 90, 100 may be movable relative to the other bar 100, 90, even during folding, as may be desired to further assist with the folding process, especially in such a tri-fold configuration.

Figure 12:
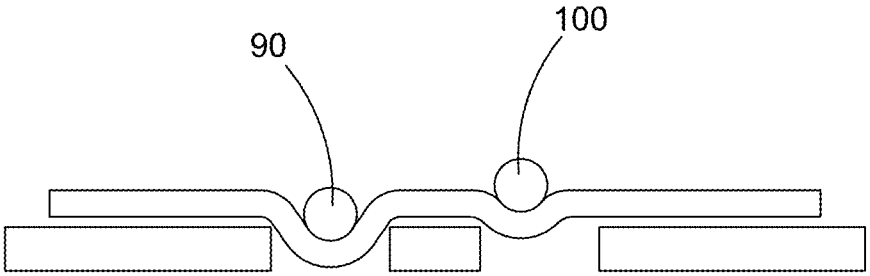
FIG. 12 is a schematic end view of that seen in FIG. 11, and with the pair of longitudinal bars in an alternate lowered position.
Figure 13:
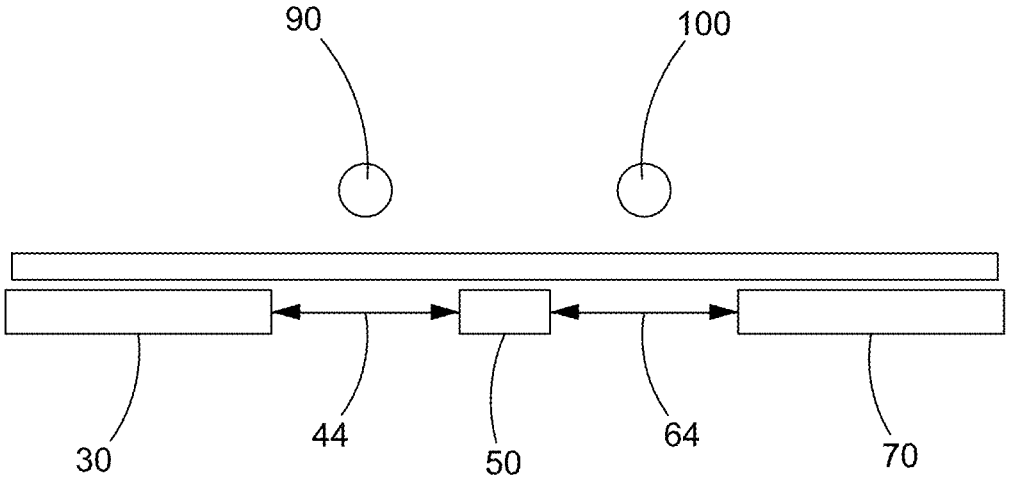
FIG. 13 is a schematic end view like that seen in FIG. 3, now of alternate features of the tri-fold machine and process.
Figure 14:
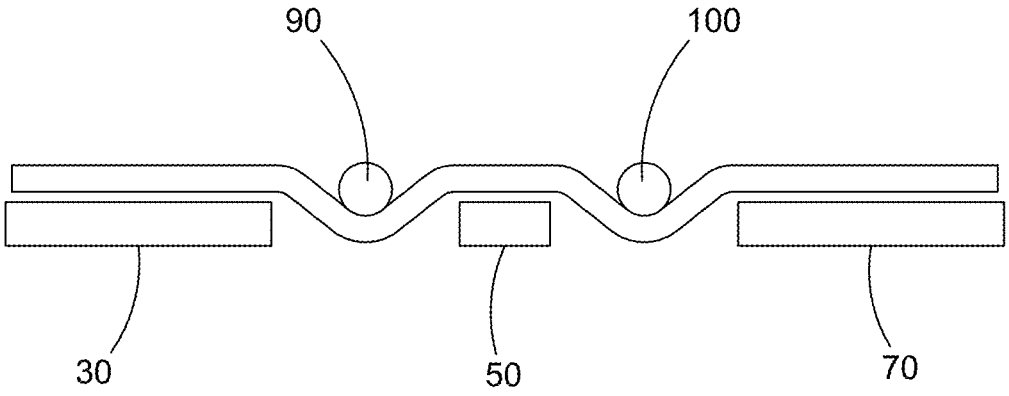
FIG. 14 is a schematic end view of that seen in FIG. 13, and with the pair of longitudinal bars in an alternate lowered position; and, FIGS. 15 and 16 are like that seen in FIG. 11, now of alternate features of the tri-fold machine and process.

Further in regards to the longitudinal bars 90, 100, and their adjustability in horizontal direction 98 (FIGS. 11 and 12), as seen in FIGS. 13 and 14 the conveyors 30, 50, 70 can also be adjustable in horizontal direction 44 (i.e., for conveyors 30 and 50 each individually, as well as relative to one another) and/or in horizontal direction 64 (i.e., for conveyors 50 and 70 each individually, as well as relative to one another). That is, preferably: (i) one of the bars 90 can be fixed relative the other bar 100, and bar 100 can be positioned further to the right relative to the bar positioning in all the prior FIGs, and then in concert with this further right position so can one or both of conveyors 50 and 70 be positioned further to the right relative to the conveyor positioning in all the prior FIGs. Preferably both conveyors are so moved to the right a sufficient distance to cause the right longitudinal gap between conveyors 50 and 70 to be centered under bar 100 (but an off-set positioning of this gap can be used too, if desired). In this way, and without being limited to a theory of understanding, this enables even more tri-fold configuration sizes of middle portion 22 of the material relative to right side 26 and left side 28, when material 20 is folded. For example, the middle portion width in horizontally direction 98 is determined by the horizontal spacing of the bars 90, 100, and so can make the middle be a true one-third of the overall width of material 20, or something less or greater than that, as desired.

Figure 15:
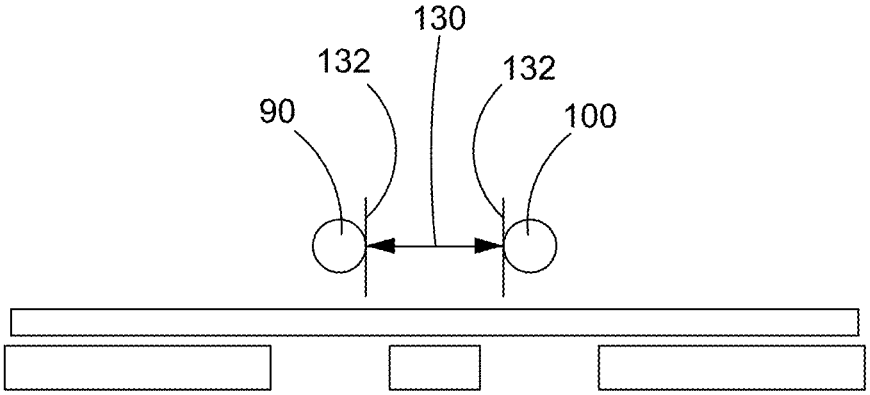
Figure 16:
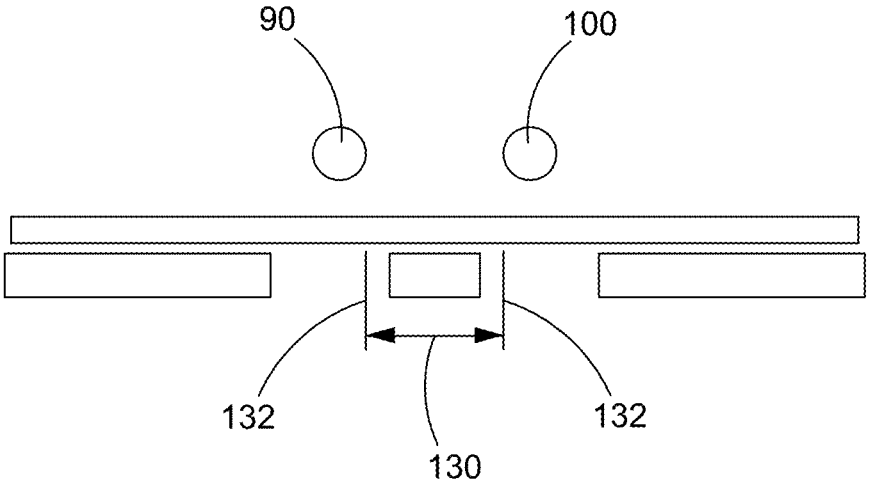

Still further in regards to the longitudinal bars 90, 100, as seen in FIGS. 1, 15 and 16, restriction force 130 can be employed coinciding with distal end 62 of middle conveyor 50 and respective ends of the bars 90, 100. In this way the force 130 acts to push the distal ends of bars 90, 100 outward, or at least prevent the distal ends of bars 90, 100 from being pressed inward of the span represented by the ends of the arrows representing force 130. That is, the proximal end 60 that corresponds to bars 90, 100 and their coupling together 108 acts to hold bars 90, 100 apart as desired (or not, as described elsewhere for the spacing of bars 90, 100 in general) during the folding process. Similarly, restriction force 130 can be employed at the opposite end of the bars 90, 100 to help hold them at a desired spaced apart location (or not, as described elsewhere for the spacing of bars 90, 100 in general) during the folding process, preferably to help form a more crisp fold along the entire length of the folded material 20. For example, force 130 could be achieved by restriction plates 132 that prevent the inward toward-each-other movement of bars 90, 100 during the folding process. Plates 132 can selectively move up and down to assist holding apart bars 90, 100 before and during folding, and then move down (FIG. 16) to get out of the way of the advancing folded material 20 when time for it to move into the roll forming stage of the packaging process. Alternatively, plates 132 could be a single horizontal plate (not shown) that has horizontal pins (not shown) projecting orthogonally therefrom toward the ends of bars 90, 100 and bars 90, 100 could have receiving holes (not shown) in the distal ends of bars 90, 100 to receive the pins and thus hold distal ends of bars 90, 100 apart when desired. Still alternatively, other mechanical structures could be employed to attain the restriction force 130, when desired, as would be known to one of ordinary skill in the art in combination with the innovative teachings herein.

The tri-fold machine 10 also includes the right-side conveyor 70 that is movable between a horizontal home position 78 and a folding position 80, as seen in progression of FIGS.

Figure 8:
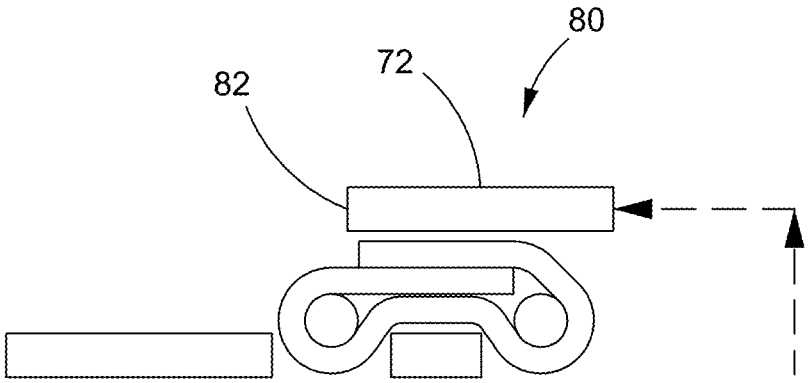
FIG. 8 is a schematic end view of that seen in FIG. 7, and with the right side of the material fully moved into the folded position and the right-side horizontal conveyor located overlying the material and the right longitudinal bar.
Figure 8A:
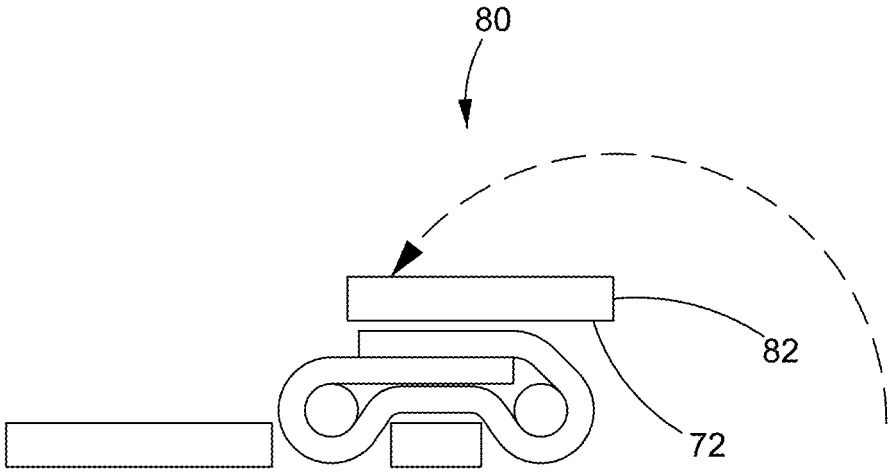
FIG. 8A is an alternate schematic end view of that seen in FIG. 8, depicting an alternate travel path for the right-side horizontal conveyor.

7 to 8A inclusive, via a travel path depicted by the dotted line arrows(s) in each of FIGS. 8 and 8A. The folding position 80 is where the right-side conveyor is located above and extending over the middle conveyor with at least some overlying overlap of conveyor 70 over conveyor 50. As seen in FIGS. 8 and 8A, there is complete overlap of conveyor 70 over conveyor 50. However, there need not be so much overlap and in one preferred aspect, the folding position 80 of the right-side conveyor can be the right-side conveyor located above and extending over the right longitudinal bar 100, completely over as seen in the figures, or even just partially over though not specifically seen in the figures. Further in this regard, more preferably, the folding position 80 of the right-side conveyor can be the right-side conveyor located above and also extending over the left longitudinal bar 90, as seen in FIGS. 8 and 8A with right-side conveyor 70 located above and extending over the left longitudinal bar 90, though only over a portion of bar 90. In another aspect of the travel path for conveyor 70, preferably the folding position 80 of the right-side conveyor can be a left edge 82 of the right-side conveyor located above and extending over the middle conveyor 50, as seen in FIG. 8. Accordingly, the movement of conveyor 70 can be first in a purely vertical direction (as represented by the up dotted arrow in FIG. 8), and then in a purely horizontal direction (as represented by the left pointing dotted arrow in FIG. 8). Alternatively, the movement of conveyor 70 can be first in a slight vertical direction (as in FIG. 7), and then in a curved vertical and horizontal direction (represented by the curved dotted arrow in FIG. 8A), as first edge 82 pivots around itself allowing the opposite edge of conveyor 70 to flip over and thereby cause the right side 26 of the material 20 to be folded over, as opposed to be pushed up and over in the FIG. 7 to FIG. 8 operation.

Figure 5:
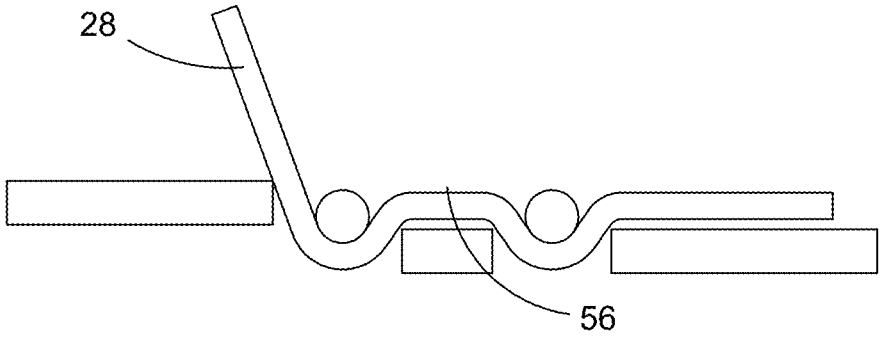
FIG. 5 is a schematic end view of that seen in FIG. 4, and with the left side of the material being moved into a folded position by the left-side horizontal conveyor.
Figure 6:
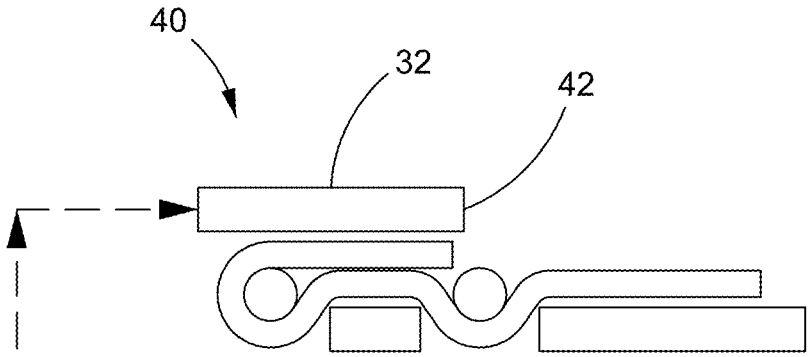
FIG. 6 is a schematic end view of that seen in FIG. 5, and with the left side of the material fully moved into the folded position and the left-side horizontal conveyor located overlying the material and the left longitudinal bar.
Figure 6A:
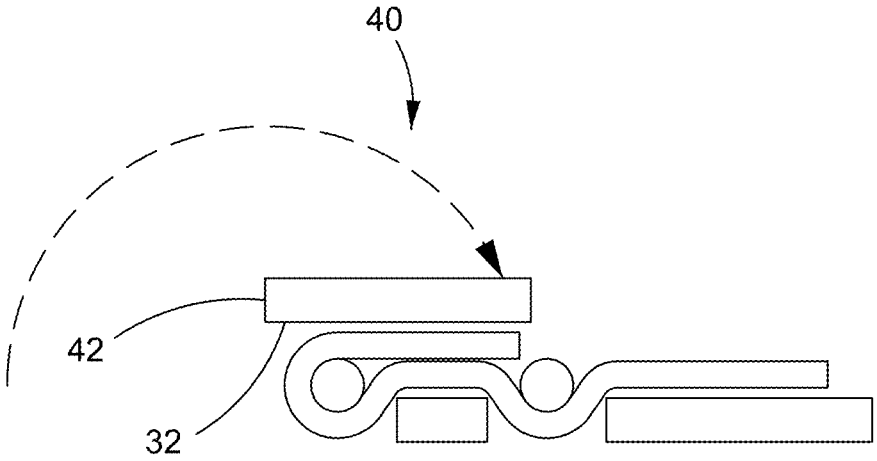
FIG. 6A is an alternate schematic end view of that seen in FIG. 6, depicting an alternate travel path for the left-side horizontal conveyor.
Figure 7:
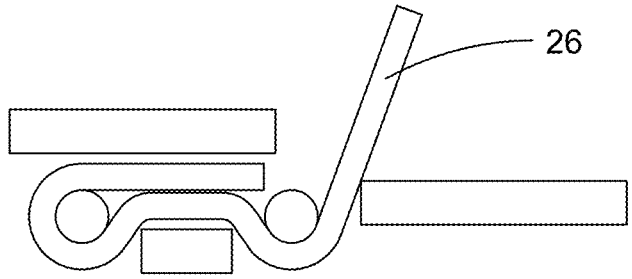
FIG. 7 is a schematic end view of that seen in FIG. 6, and with the right side of the material being moved into a folded position by the right-side horizontal conveyor.

In a similar regard, the tri-fold machine 10 also includes the left-side conveyor 30 that is movable between a horizontal home position 38 and a folding position 40, as seen in progression of FIGS. 5 to 6A inclusive, via a travel path depicted by the dotted line arrows(s) in each of FIGS. 6 and 6A. The folding position 40 is where the left-side conveyor is located above and extending over the middle conveyor with at least some overlying overlap of conveyor 30 over conveyor 50. As seen in FIGS. 6 and 6A, there is complete overlap of conveyor 30 over conveyor 50. However, there need not be so much overlap and in one preferred aspect, the folding position 40 of the left-side conveyor can be the left-side conveyor located above and extending over the left longitudinal bar 90, completely over as seen in the figures, or even just partially over though not specifically seen in the figures. Further in this regard, more preferably, the folding position 40 of the left-side conveyor can be the left-side conveyor located above and extending over the right longitudinal bar 100, as seen in FIGS. 6 and 6A with left-side conveyor 30 located above and extending over the right longitudinal bar 100, though only a portion of bar 100. In another aspect of the travel path for conveyor 30, preferably the folding position 40 of the left-side conveyor can be a right edge 42 of the left-side conveyor located above and extending over the middle conveyor 50, as seen in FIG. 6. Accordingly, the movement of conveyor 30 can be first in a purely vertical direction (as represented by the up dotted arrow in FIG. 6), and then in a purely horizontal direction (as represented by the right pointing dotted arrow in FIG. 6). Alternatively, the movement of conveyor 30 can be first in a slight vertical direction (as in FIG. 5), and then in a curved vertical and horizontal direction (represented by the curved dotted arrow in FIG. 6A), as first edge 42 pivots around itself allowing the opposite edge of conveyor 30 to flip over and thereby cause the left side 28 of the material 20 to be folded over, as opposed to be pushed up and over in the FIG. 5 to FIG. 6 operation.

Figure 9:
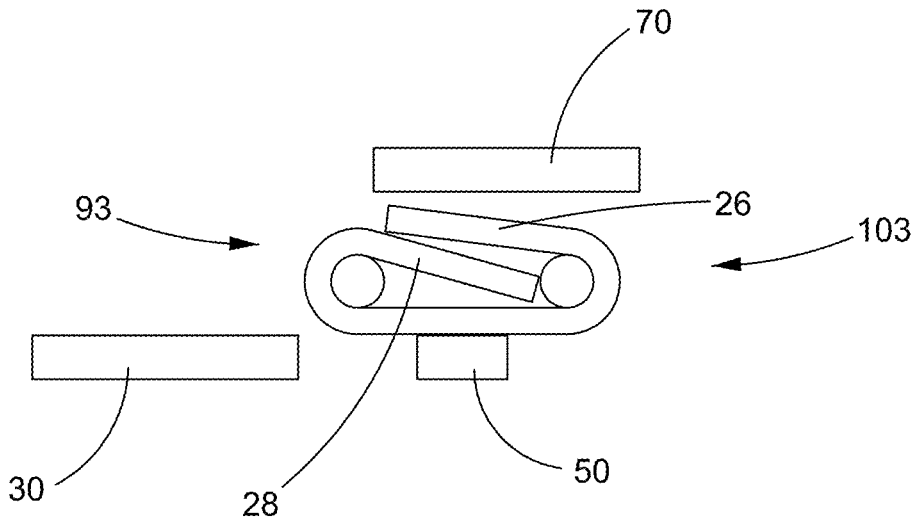
FIG. 9 is a schematic view of that in FIG. 8, but now with the pair of longitudinal bars located between the raised position and the lowered position to release the middle portion of the material from being in the longitudinal gap formed on each side of the middle conveyor.
Figure 10:
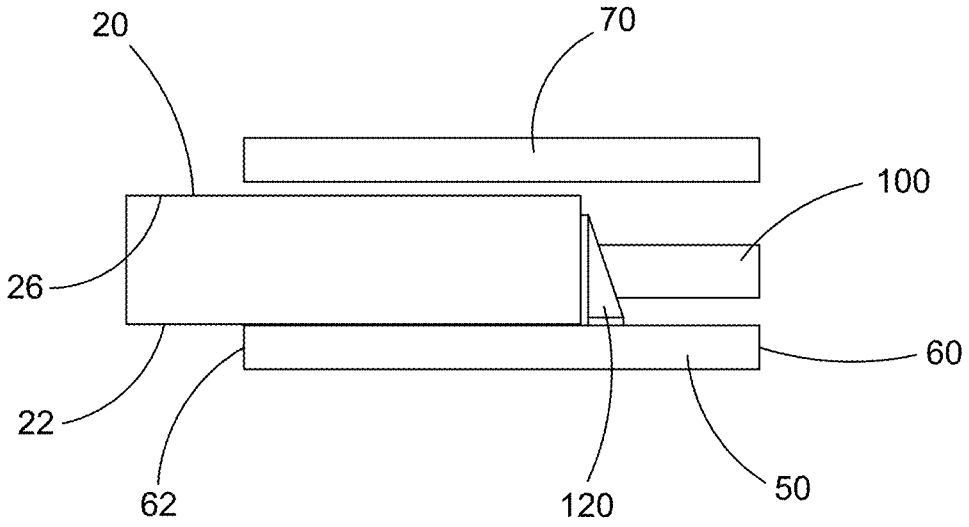
FIG. 10 is a side schematic view of that in FIG. 9, as the material is pushed from a proximal end of the middle conveyor toward a distal end of the middle conveyor to advance downstream of the machine for further package processing.

Referring to FIGS. 9 and 10, once the material is tri-folded, right side 26 over left side 28, and both over middle portion 22, preferably the pair of longitudinal bars 90, 100 are moved up to a partially raised position 93, 103 and located between the raised position and the lowered position to release the middle portion of the material from being in the longitudinal gaps formed on each side of the middle conveyor. Then, a pusher bar(s) 120 can be located adjacent proximal end 60 of the middle conveyor and can be operable to move longitudinally from the proximal end of the middle conveyor to distal end 62 of the middle conveyor. That is, bar 120 can push the material from proximal end 60 toward distal end 62 to advance the material to downstream conveyor 14. Bar 120 uses a conventional mechanism to cause the tri-folded material to be pushed over conveyor 50 and off of bars 90, 100 in direction 15 (FIG. 1) by linear movement of the same. The upper surface of conveyor 14 aids in moving material 20 in direction 15 for further package processing. For example, this can include rolling up the tri-folded material into an even more compact package, with equipment and process taught by a conventional roll cage, or preferably, as taught by applicant's U.S. patent application Ser. No. 17/081,639, filed Oct. 27, 2020 and titled: VARIABLE ROLL CAGE MACHINE AND PROCESS.

Also disclosed here is a process for tri-folding, preferably compressed material 12, and more preferably high expansion force compressed material, like a mattress. Such process can be employed by machine 10, for example, and as discussed below for reference. The process comprises a variety of steps and while some steps can be performed in any order, some steps have an order dictated by their nature and the results desired, but when this is not the case the order can be varied. In reference to FIGS. 3-10, for example, the process includes positioning the material 20 on the left-side horizontal conveyor 30 and the right-side horizontal conveyor 70, with the middle conveyor 50 located between the left-side horizontal conveyor and the right-side horizontal conveyor, and longitudinal gaps 52, 58 formed on each side of the middle conveyor. A next step is pressing the middle portion 22 of the material into at least one longitudinal gap 52, 58, and preferably both gaps 52, 58. Another step is folding the left side 28 of the material over the middle portion 22 of material 20. And, there is the step folding the right side 26 of the material over the left side 28 of the material which is located over the middle portion 22 of the material. As discussed earlier, and/or depending on your point of reference, alternatively, the right side could be first folded over the middle portion and then the left side folded over the right side that is already folded over the middle portion. Additionally, if desired, the process can be where positioning is operating the surface of each of the left-side horizontal conveyor and the right-side horizontal conveyor, as well as the middle conveyor, to locate the material into the material folding position and in FIG. 3, and then the balance of steps depicted in FIGS. 4-10, inclusive, performed.

Other aspects of the process are directed to the orientation and operation of the conveyors. For example, the process can include folding the left side 28 of the material by moving the left-side conveyor 30 from the horizontal home position 38 to the folding position 40. The folding position can be achieved by locating the left-side conveyor above and extending over the middle conveyor, for example, by the travel path in FIG. 6 or 6A, as described previously. Preferably, folding of the left side 28 of the material includes positioning the right edge 42 of the left-side conveyor above and extending over the middle conveyor, as seen in FIG. 6. Either way conveyor 30 moves, because the material 20 is in a dense, highly compressed state, it tends to be somewhat stiff but also flexible under its own weight when folded. That is, as the left side 28 moves from its position in FIG. 5 to that of FIG. 6 or 6A, the weight of material 20 tends to flop it over onto itself and hold it there. Preferably the left side 28 is folded onto the middle 22 before the right side 26 is folded on top, but it could be in reverse too.

In a similar regard as the left conveyor 30, the process can then include folding the right side 26 of the material by moving the right-side conveyor 70 from the horizontal home position 78 to the folding position 80. The folding position can be achieved by locating the right-side conveyor above and extending over the middle conveyor, for example, by the travel path in FIG. 8 or 8A, as described previously. Preferably, folding of the right side 26 of the material includes positioning the left edge 82 of the right-side conveyor above and extending over the middle conveyor, as seen in FIG. 8. Either way conveyor 70 moves, because material 20 is in a dense, highly compressed state, it tends to be somewhat stiff but also flexible under its own weight when folded. That is, as the right side 26 moves from its position in FIG. 7 to that of FIG. 8 or 8A, its weight tends to flop it over onto itself and hold it there.

In still other aspects of the process, it can include operating the pair of spaced apart longitudinal bars 90, 100 between (i) the raised position 92, 102 where the bottom surface 94, 104 is spaced from and above horizontal plane 34 defined by upper surface 32, 72 of each of the left-side horizontal conveyor and the right-side horizontal conveyor. Additionally, preferably the process as related to bars 90, 100, also includes (ii) a lowered position where the bottom surface is located closer to the horizontal plane than in the raised position. For example, even more preferably, the lowered position can be pressing the middle portion 22 by moving the pair of spaced apart longitudinal bars 90, 100 into the fully lowered position and the bottom surfaces 94, 104 are engaging the top surface 24 of the material adjacent to surfaces 94, 104 and bars 90, 100 thereby press the material into the longitudinal gaps 52, 58 respectively. Still more preferably, movement of bars, 90, 100 can be by simultaneously positioning the pair of longitudinal bars together, and particularly so relative to the middle conveyor 50.

Related to and building upon one or more of these points, other aspects are directed to certain capabilities of parts of the machine and/or the process. For example, and as seen in FIGS. 9-10, the process can include releasing the middle portion 22 of the material from being in the longitudinal gaps 52, 58 formed on each side of the middle conveyor. In conjunction with this, and while not necessarily needed due to the weight of the sides holding themselves in place once reaching the folded configuration seen in FIGS. 8/8A, preferably to best ensure crisp folding and maintenance of the same throughout the process, the process can further include holding the right side of the material over the left side of the material, for example by use of conveyor 70 as seen in FIG. 9. Next, the process can include pushing the material 20 from the proximal end 60 of the middle conveyor toward the distal end 62 of the middle conveyor. And, preferably, holding and pushing occur simultaneously. Finally, and while not shown expressly it is easily understood as described here, as material 20 is pushed completely off of bars 90, 100 it simultaneously moves onto the downstream conveyor 14 (FIG. 1). Conveyor 14 has an upper surface which travels in direction 15 to help carry the folded material onto the next step in the packaging process, for example, as taught by applicant's U.S. patent application Ser. No. 17/081,639, filed Oct. 27, 2020 and titled: VARIABLE ROLL CAGE MACHINE AND PROCESS.

Figure 11:
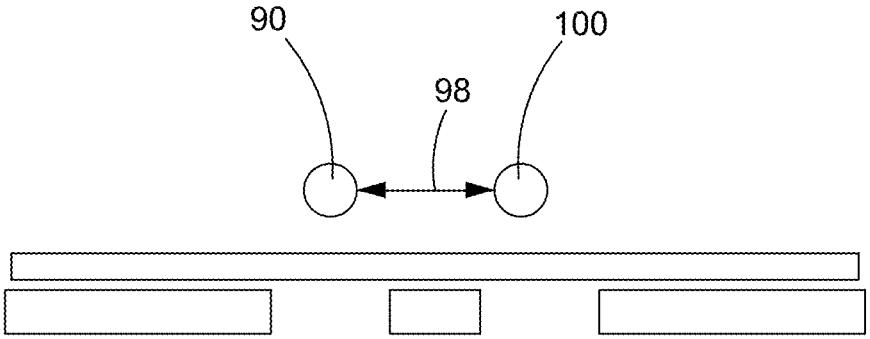
FIG. 11 is a schematic end view like that seen in FIG. 3, now of alternate features of the tri-fold machine and process.

In yet other aspects, the process can include adjusting longitudinal bars 90, 100 in the horizontal direction 98 (FIGS. 11 and 12). Further, preferably, the process includes fixing at least one of bars 90 or 100 relative to the conveyors 30, 50, 70 and adjusting the other of the bars 100 or 90 relative to that bar. Additionally, or alternatively, preferably the process includes adjusting both bars 90 and 100 relative to the conveyors 30, 50, 70 and relative to each other bar 100, 90. In this way, and without being limited to a theory of understanding, this enables various tri-fold configuration sizes of middle portion 22 of the material relative to right side 26 and left side 28, when material 20 is folded. For example, the middle portion width in horizontally direction 98 is determined by the horizontal spacing of the bars 90, 100, and so can make the middle be a true one-third of the overall width of material 20, or something less or greater than that, as desired. Further, more preferably, the process includes temporarily fixing the bars 90, 100 relative to one another when being used to fold the material around the bars. However, it is also contemplated that the process can include moving at least one of the bars 90, 100 relative to the other bar 100, 90, even during folding, as may be desired to further assist with the folding process, especially in such a tri-fold configuration.

In still other aspects, the process can include adjusting one or more of horizontal conveyors 30, 50 and 70 in the horizontal direction 44 and/or horizontal direction 64 (FIGS. 13 and 14). Further, preferably, the process includes fixing at least one of bars 90 or 100 relative to the conveyors 30, 50, 70 and adjusting the other of the bars 100 or 90 relative to that bar. Additionally, or alternatively, preferably the process includes adjusting one or both of conveyors 50 and 70 be positioned a sufficient distance to cause the right longitudinal gap between conveyors 50 and 70 to be centered under bar 100 (but an off-set positioning of this gap can be used too, if desired). In this way, and without being limited to a theory of understanding, this enables even more tri-fold configuration sizes of middle portion 22 of the material relative to right side 26 and left side 28, when material 20 is folded. For example, the middle portion width in horizontally direction 98 is determined by the horizontal spacing of the bars 90, 100, and so can make the middle be a true one-third of the overall width of material 20, or something less or greater than that, as desired.

Additional discussion of embodiments in various scopes now follows:

A. A tri-fold machine to fold up compressed high expansion force material. The machine includes a left-side horizontal conveyor next to a middle conveyor with a left longitudinal gap formed between the left-side horizontal conveyor and the middle conveyor. The machine also includes a right-side horizontal conveyor next to an opposite side of the middle conveyor with a right longitudinal gap formed between the right-side horizontal conveyor and the middle conveyor. An upper surface of each of the left-side horizontal conveyor and the right-side horizontal conveyor is defining a horizontal plane. The machine also includes a left longitudinal bar operable between (i) a raised position where a bottom surface is spaced from and above the horizontal plane and (ii) a lowered position where the bottom surface is located closer to the horizontal plane than in the raised position. Further, the machine includes a right longitudinal bar operable between (i) a raised position where a bottom surface is spaced from and above the horizontal plane and (ii) a lowered position where the bottom surface is located closer to the horizontal plane than in the raised position. The right-side conveyor is movable between a horizontal home position and a folding position. The folding position is where the right-side conveyor is located above and extending over the middle conveyor. The left-side conveyor is movable between a horizontal home position and a folding position. The folding position is where the left-side conveyor is located above and extending over the middle conveyor.

B. The machine of any of the prior embodiments, wherein the folding position of the right-side conveyor comprises the right-side conveyor located above and extending over the right longitudinal bar.

C. The machine of any of the prior embodiments, wherein the folding position of the right-side conveyor comprises the right-side conveyor located above and extending over the left longitudinal bar.

D. The machine of any of the prior embodiments, wherein the folding position of the left-side conveyor comprises the left-side conveyor located above and extending over the left longitudinal bar.

E. The machine of any of the prior embodiments, wherein the folding position of the left-side conveyor comprises the left-side conveyor located above and extending over the right longitudinal bar.

F. The machine of any of the prior embodiments, wherein the left longitudinal bar and the right longitudinal bar are coupled together such that each longitudinal bar is movable between the raised position and the lowered position simultaneously.

G. The machine of any of the prior embodiments, wherein the bottom surface of at least one of the left longitudinal bar and the right longitudinal bar is equal with to below the horizontal plane when in the lowered position.

H. The machine of any of the prior embodiments, further including the compressed high expansion force material positionable on the left-side conveyor and the right-side conveyor with the left longitudinal bar overlying a middle portion of the material and the bottom surface of the left longitudinal bar spaced from a top surface of the material when the left longitudinal bar is in the raised position.

I. The machine of any of the prior embodiments, wherein the bottom surface of the left longitudinal bar is in contact with the top surface of the material when the left longitudinal bar is in the lowered position.

J. The machine of any of the prior embodiments, wherein the left longitudinal bar presses the material into the left longitudinal gap when the left longitudinal bar is in the lowered position.

K. The machine of any of the prior embodiments, further including a pusher bar located adjacent a proximal end of the middle conveyor and operable to move longitudinally from the proximal end of the middle conveyor to a distal end of the middle conveyor.

L. The machine of any of the prior embodiments, wherein the left-side horizontal conveyor and the right-side horizontal conveyor each have a movable surface to locate the material into a material folding position relative to the left longitudinal bar and the right longitudinal bar.

M. The machine of any of the prior embodiments, wherein the folding position of the right-side conveyor comprises a left edge of the right-side conveyor located above and extending over the middle conveyor.

N. The machine of any of the prior embodiments, wherein the folding position of the left-side conveyor comprises a right edge of the left-side conveyor located above and extending over the middle conveyor.

O. The machine of any of the prior embodiments, wherein the left longitudinal bar is sized to fit in the left longitudinal gap.

P. The machine of any of the prior embodiments, wherein the right longitudinal bar is sized to fit in the right longitudinal gap.

Q. The machine of any of the prior embodiments, wherein at least one of the left longitudinal bar and the right longitudinal bar is adjustable relative to each other.

R. The machine of any of the prior embodiments, wherein adjustable comprises in a horizontal direction relative to each other.

S. The machine of any of the prior embodiments, wherein adjustable comprises in a vertical direction relative to each other.

T. The machine of any of the prior embodiments, wherein at least one of the left-side horizontal conveyor, the right-side horizontal conveyor and the middle conveyor is adjustable relative to at least one other conveyor.

U. The machine of any of the prior embodiments, wherein the conveyor(s) being adjustable comprises in a horizontal direction.

V. The machine of any of the prior embodiments, further comprising a restriction force that acts on each distal end of the left horizontal bar and the right horizontal bar to hold each distal end at a spaced apart location.

W. A process for tri-folding a compressed high expansion force material. The process including positioning the material on a left-side horizontal conveyor and a right-side horizontal conveyor, with a middle conveyor located between the left-side horizontal conveyor and the right-side horizontal conveyor and a longitudinal gap formed on each side of the middle conveyor. And, pressing a middle portion of the material into the longitudinal gap formed on each side of the middle conveyor. The process also including folding a left side of the material over the middle portion of material. And, folding a right side of the material over the left side of the material which is located over the middle portion of the material. These steps can, preferably, occur in this order.

X. The process of any of the prior process embodiments, further including releasing the middle portion of the material from being in the longitudinal gap formed on each side of the middle conveyor.

Y. The process of any of the prior process embodiments, further including holding the right side of the material over the left side of the material.

Z. The process of any of the prior process embodiments, further including pushing the material from a proximal end of the middle conveyor toward a distal end of the middle conveyor.

AA. The process of any of the prior process embodiments, wherein holding and pushing occur simultaneously.

BB. The process of any of the prior process embodiments, wherein folding the right side of the material comprises moving the right-side conveyor from a horizontal home position to a folding position where the folding position comprises locating the right-side conveyor above and extending over the middle conveyor.

CC. The process of any of the prior process embodiments, wherein folding the left side of the material comprises moving the left-side conveyor from a horizontal home position to a folding position where the folding position comprises locating the left-side conveyor above and extending over the middle conveyor.

DD. The process of any of the prior process embodiments, further including operating a pair of spaced apart longitudinal bars between (i) a raised position where a bottom surface is spaced from and above a horizontal plane defined by an upper surface of each of the left-side horizontal conveyor and the right-side horizontal conveyor and (ii) a lowered position where the bottom surface is located closer to the horizontal plane than in the raised position.

EE. The process of any of the prior process embodiments, wherein pressing the middle portion comprises moving the pair of spaced apart longitudinal bars into the lowered position and the bottom surface presses the material into the longitudinal gap.

FF. The process of any of the prior process embodiments, further including simultaneously positioning the pair of longitudinal bars together.

GG. The process of any of the prior process embodiments, wherein positioning comprises operating a surface of each of the left-side horizontal conveyor and the right-side horizontal conveyor to locate the material into a material folding position.

HH. The process of any of the prior process embodiments, wherein folding of the right side of the material further comprises positioning a left edge of the right-side conveyor above and extending over the middle conveyor.

II. The process of any of the prior process embodiments, wherein the folding of the left side of the material further comprises positioning a right edge of the left-side conveyor above and extending over the middle conveyor.

JJ. The process of any of the prior process embodiments, further including adjusting at least one of the left longitudinal bar and the right longitudinal bar relative to each other.

KK. The process of any of the prior process embodiments, wherein adjusting comprises moving in a horizontal direction relative to each other.

LL. The process of any of the prior process embodiments, wherein adjusting comprises moving in a vertical direction relative to each other.

MM. The process of any of the prior process embodiments, wherein adjusting comprises moving the at least one of the left longitudinal bar and the right longitudinal bar before both folding steps begin.

NN. The process of any of the prior process embodiments, further comprising adjusting at least one of the left-side horizontal conveyor, the right-side horizontal conveyor and the middle conveyor relative to at least one other conveyor.

OO. The process of any of the prior process embodiments, wherein adjusting the conveyor(s) comprises in a horizontal direction.

PP. The process of any of the prior process embodiments, further comprising restricting each distal end of the left horizontal bar and the right horizontal bar at a spaced apart location relative to each other during the folding steps.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the packaging arts, and all such modifications and other embodiments are intended and deemed to be within the scope of the invention.

What is claimed is:

1. A tri-fold machine to fold up compressed high expansion force material comprising:

a left-side horizontal conveyor next to a middle conveyor with a left longitudinal gap formed between the left-side horizontal conveyor and the middle conveyor;

a right-side horizontal conveyor next to a side of the middle conveyor opposite the left-side horizontal conveyor and with a right longitudinal gap formed between the right-side horizontal conveyor and the middle conveyor;

an upper surface of each of the left-side horizontal conveyor and the right-side horizontal conveyor defining a horizontal plane by and between each upper surface of the left-side horizontal conveyor and the right-side horizontal conveyor;

a left longitudinal bar operable between (i) a raised position where a bottom surface of the left longitudinal bar is spaced from and above the horizontal plane and (ii) a lowered position where the bottom surface is located closer to the horizontal plane than in the raised position;

a right longitudinal bar operable between (i) a raised position where a bottom surface of the right longitudinal bar is spaced from and above the horizontal plane and (ii) a lowered position where the bottom surface is located closer to the horizontal plane than in the raised position;

the right-side conveyor movable between a horizontal home position and a folding position, the folding position is where the right-side conveyor is located above and extending over the middle conveyor; and, the left-side conveyor movable between a horizontal home position and a folding position, the folding position is where the left-side conveyor is located above and extending over the middle conveyor.

2. The machine of claim 1, wherein the folding position of the right-side conveyor comprises the right-side conveyor located above and extending over the right longitudinal bar.

3. The machine of claim 2, wherein the folding position of the right-side conveyor comprises the right-side conveyor located above and extending over the left longitudinal bar.

4. The machine of claim 1, wherein the folding position of the left-side conveyor comprises the left-side conveyor located above and extending over the left longitudinal bar.

5. The machine of claim 4, wherein the folding position of the left-side conveyor comprises the left-side conveyor located above and extending over the right longitudinal bar.

6. The machine of claim 1, wherein the left longitudinal bar and the right longitudinal bar are coupled together such that each longitudinal bar is movable between the raised position and the lowered position simultaneously.

7. The machine of claim 1, wherein the bottom surface of at least one of the left longitudinal bar and the right longitudinal bar is equal with or to below the horizontal plane when in the lowered position.

8. The machine of claim 1 further comprising the compressed high expansion force material positionable on the left-side conveyor and the right-side conveyor with the left longitudinal bar overlying a middle portion of the material and the bottom surface of the left longitudinal bar spaced from a top surface of the material when the left longitudinal bar is in the raised position.

9. The machine of claim 8, wherein the bottom surface of the left longitudinal bar is in contact with the top surface of the material when the left longitudinal bar is in the lowered position.

10. The machine of claim 9, wherein the left longitudinal bar presses the material into the left longitudinal gap when the left longitudinal bar is in the lowered position.

11. The machine of claim 1, further comprising a pusher bar located adjacent a proximal end of the middle conveyor and operable to move longitudinally from the proximal end of the middle conveyor to a distal end of the middle conveyor.

12. The machine of claim 1, wherein the left-side horizontal conveyor and the right-side horizontal conveyor each have a movable surface to locate the material into a material folding position relative to the left longitudinal bar and the right longitudinal bar.

13. The machine of claim 1, wherein the folding position of the right-side conveyor comprises a left edge of the right-side conveyor located above and extending over the middle conveyor.

14. The machine of claim 1, wherein the folding position of the left-side conveyor comprises a right edge of the left-side conveyor located above and extending over the middle conveyor.

15. The machine of claim 1, wherein the left longitudinal bar is sized to fit in the left longitudinal gap.

16. The machine of claim 1, wherein the right longitudinal bar is sized to fit in the right longitudinal gap.

17. The machine of claim 1, wherein at least one of the left longitudinal bar and the right longitudinal bar is adjustable relative to each other.

18. The machine of claim 1, wherein at least one of the left longitudinal bar and the right longitudinal bar is adjustable in a horizontal direction relative to each other.

19. The machine of claim 1, wherein at least one of the left longitudinal bar and the right longitudinal bar is adjustable in a vertical direction relative to each other.

20. The machine of claim 1, wherein at least one of the left-side horizontal conveyor, the right-side horizontal conveyor and the middle conveyor is adjustable relative to at least one other conveyor.

21. The machine of claim 20, wherein at least one of the left-side horizontal conveyor, the right-side horizontal conveyor and the middle conveyor is adjustable in a horizontal direction.

22. The machine of claim 1, wherein the machine is configured to apply a restriction force that acts on each distal end of the left horizontal bar and the right horizontal bar to hold each distal end at a spaced apart location.

* * * * *